US007176167B2

(12) United States Patent
Akiyama et al.

(10) Patent No.: US 7,176,167 B2
(45) Date of Patent: Feb. 13, 2007

(54) VIBRATION RESISTANT BEARING

(76) Inventors: Motoharu Akiyama, c/o Minebea Co., Ltd. 4106-73 Miyota, Oaza, Miyota-Machi, Kitasaku-Gun, Nagano-Ken, 389-0293 (JP); Noriyuki Yoshimura, c/o Minebea Co., Ltd. 4106-73 Miyota, Oaza, Miyota-Machi, Kitasaku-Gun, Nagano-Ken, 389-0293 (JP)

( * ) Notice: Subject to any disclaimer, the term of this patent is extended or adjusted under 35 U.S.C. 154(b) by 111 days.

(21) Appl. No.: 10/440,386

(22) Filed: May 16, 2003

(65) Prior Publication Data

US 2003/0220207 A1 Nov. 27, 2003

(30) Foreign Application Priority Data

May 21, 2002 (JP) ..... 2002-146901

(51) Int. Cl.
*C10M 141/12* (2006.01)
*F16C 32/00* (2006.01)

(52) U.S. Cl. ..... 508/108; 508/363; 508/365; 508/379; 508/433; 508/462; 508/485; 508/591; 384/13

(58) Field of Classification Search ..... 508/365, 508/108
See application file for complete search history.

(56) References Cited

U.S. PATENT DOCUMENTS

| | | | | |
|---|---|---|---|---|
| 5,631,211 | A * | 5/1997 | Nakagawa et al. | 508/108 |
| 5,656,582 | A * | 8/1997 | Shiraishi et al. | 508/108 |
| 5,922,654 | A * | 7/1999 | Yamazaki et al. | 508/364 |
| 6,022,835 | A * | 2/2000 | Fletcher | 508/365 |
| 6,271,182 | B1 | 8/2001 | Akiyama | |
| 6,482,779 | B2 * | 11/2002 | Naka et al. | 508/379 |
| 6,730,639 | B1 * | 5/2004 | Miyamoto et al. | 508/364 |
| 2002/0002119 | A1 | 1/2002 | Naka et al. | |

* cited by examiner

*Primary Examiner*—Ellen M. McAvoy
(74) *Attorney, Agent, or Firm*—James A. Quinton

(57) ABSTRACT

According to the invention, a self contained vibration resistant bearing is provided. The bearing is coated with a film formed from a rust preventive oil having an extreme-pressure additive content of 0.5 to 10% by weight. Desirably the extreme-pressure additive is an organometallic compound, an organofatty acid compound, organofatty acid derivative, an organophosphoric acid compound or a combination of two(2) or more of such compounds. When a rust preventive film that contains an extreme-pressure additive is formed all over bearing components during the assembling process, the bearing components are fully protected even from sudden vibrations from transportation.

34 Claims, No Drawings

VIBRATION RESISTANT BEARING

BACKGROUND OF THE INVENTION

1. Field of the Invention

The present invention relates to a vibration resistant bearing, its manufacturing method, and its application. The invention provides for a vibration resistant bearing, its manufacturing method, and its application, wherein a product having the bearing does not require extra packaging materials such as styrene foam and cushioning materials, or extra effort to arrange the products (orientation) for transportation on a badly conditioned road, and can be transported to a destination for its assembly without its performance deteriorating as a bearing.

2. Description of the Prior Art

In recent years, information devices, such as air conditioners, computers and VCR's, are manufactured in developing countries. However, a manufacturing location of parts such as motors is often a few hundreds to a few thousands kilometers away from an assembling location of the information devices such as air conditioners, computers, computer peripherals and VCR's. Therefore, when the parts are transported to an assembling factory, the race surfaces of bearings are often damaged due to vibrations on badly conditioned roads, and the performance of finely made bearings is often deteriorated.

Conventionally, bearings such as rolling ball bearings and roller bearings are used for information devices, and the ball or the race surfaces for rollers of the bearings are damaged by about 5 to 25 Hz of low frequency vibrations at the time of shipping in and out of transporting information devices. This phenomenon is called "fretting". To solve this problem, an extreme-pressure additive has been added to a grease composition to fill in bearing spaces, as disclosed in Japanese unexamined patent application publication Nos. 2001-139979 and 2001-335792.

In a conventional method, an extreme-pressure additive is added only to the grease to fill bearing spaces and a rust-preventive film composed of the extreme-pressure additive is not formed on an inner and outer wheel and balls that compose the bearing. In this case, the extreme-pressure additive in the extreme-pressure additive grease does not fully coat rolling surfaces of each component, so the bearing will be damaged by fretting or the like, due to vibrations at the time of the transportation.

Conventionally, each bearing component such as an inner and outer wheel and a ball is cleaned to remove contamination. The cleaning processes are performed after the bearings have been mechanical processed, both before and after assembling, but before being filled with the grease. The contaminants often present are oil, debris, various organic substances and ion contaminants. Different cleaning liquids are used to clean each type of contaminant.

When the bearing components are made of ferrous materials, the cleaning processes causes those components to rust more easily because their surfaces have been activated. In addition, it should as well be noted that the oil on their surfaces is removed through the cleaning. Therefore, a process is required to prevent the bearings from rusting after the cleaning process. For this reason, there is usually a rust preventive process after the drying process in the cleaning process, where the bearing is immersed in a bath of a rust preventive processing solution that includes a volatile solvent and rust preventive oil. Here, a rust preventive agent is diluted to 1 to 5% by volume in the rust preventive oil. The rust preventive oil used in this rust preventive process is conventionally a rust preventive lubricating oil that mainly contains mineral oil, synthetic oil, etc. Here, the synthetic oil is carbonic ester, diester, polyol ester, poly(α-olefin) (PAO), etc.

SUMMARY OF THE INVENTION

According to the invention, a self contained vibration resistant bearing is provided. The bearing is coated with a film formed from a rust preventive oil having an extreme-pressure additive content of 0.5 to 10% by weight. Desirably the extreme-pressure additive is an organometallic compound, an organofatty acid compound, organofatty acid derivative, an organophosphoric acid compound or a combination of two(2) or more of such compounds. When a rust preventive film that contains an extreme-pressure additive is formed all over bearing components during the assembling process, the bearing components are fully protected even from sudden vibrations from transportation. This is because the rust preventive film containing the extreme-pressure additive has been formed before transportation.

In another aspect of the invention, a method of manufacturing bearings having self contained vibration resistant properties is provided. After assembling and cleaning the bearing, but before adding the extreme-pressure additive to a lubricating oil or a grease composition to fill bearing spaces, the bearing is immersed in a rust preventive solution bath with a volatile solvent and a rust preventive oil that contains the extreme-pressure additive in and amount 0.5 to 10% by weight of rust preventive oil, and preferably a rust preventive agent. The bearing is then dried and the volatile solvent is removed. According to this process, the rust and vibration resistant film containing the extreme-pressure additive coats all of the surfaces of the bearing. Therefore, deterioration of the bearing due to vibrations from a badly conditioned road at the time of transportation is retarded.

Desirably the rust and vibration resistant film coats all of the surfaces of the bearing including the race, inner and outer wheel and rolling components such as balls. When the bearings according to the invention are incorporated in motors, the motors can endure vibrations from a badly conditioned road at the time of transportation, and unexpectedly exhibit better results than with motors in which bearing spaces are filled with a grease composition or a lubricating oil containing an extreme-pressure additive.

The preferred embodiment of the present invention is illustrated in the detailed description and examples. However, it should be expressly, understood that the present invention should not be limited solely to the illustrative embodiment.

DETAILED DESCRIPTION OF THE INVENTION

According to the invention, a self contained vibration resistant bearing is provided. The bearing is coated with a film formed from a rust preventive oil having an extreme-pressure additive content of 0.5 to 10% by weight. Desirably the extreme-pressure additive is an organometallic compounds, organofatty acid compounds, organofatty acid derivatives, an organophosphoric acid compounds or a combination of two(2) or more of such compounds. Preferably the extreme pressure additive is present in the rust preventive in an amount 1 to 4 percent by weight.

Desirably the organometallic compounds that the present invention are ones that can be adsorbed on a metal surface and form a very reactive coating film. The compounds work as an extreme-pressure additive, and are added in to improve burn resistance, load capacity and wear resistance under a high load and slow speed. In particular, molybdenum diphosphate (Mo-DTP), molybdenum dithiocarbamate (Mo-DTC) or tricresyl phosphate (TCP) are preferably used.

Other compounds that can be desirably used as extreme-pressure additives, such as metal dihydrocarbyldithiophosphates, metal dihydrocarbyldithiocarbamates or naphthenic salts, which can be used alone or in combination.

Metal dihydrocarbyldithiophosphates useful in the invention as extreme-pressure additives include for example, zinc dimethyldithiophosphate, zinc butylisooctyldithiophosphate, zinc di(4-methyl-2-pentyl)dithiophosphate, zinc di(tetrapropenylphenyl)dithiophosphate, zinc(2-ethyl-1-hexyl)dithiophosphate, zinc (isooctyl)dithiophosphate, zinc (ethylphenyl)dithiophosphate, zinc(amyl)dithiophosphate and zinc di(hexyl)dithiophosphate can be used. In addition to the above-mentioned zinc, a metal such as lead, cadmium and antimony can be used as extreme-pressure additives.

Organofatty acid compounds, or organofatty acid derivatives which can be used in the present invention as extreme-pressure additives include for example oleic acid, naphthenic acid, abietic acid (resin acid), lanolin fatty acid, succinic acid and amino acid derivatives. As for the succinic acid compounds, alkenylsuccinic acid or its anhydride is preferred. For the succinic acid derivatives, the examples are succinic acid, alkylsuccinic acid, alkylsuccinic half ester, alkenylsuccinic acid, alkenylsuccinic half ester and succinimide. The succinic acid derivatives can be used alone or optionally combined together.

The organophosphorus compound used in the present invention as extreme-pressure additives is preferably a phosphorous ester. For the phosphorous esters, the examples include trioctyl phosphite, triphenyl phosphite, tricresyl phosphite, bis2-ethylhexyl phosphite, tridecyl phosphite, dibutyl hydrogenphosphite, tris(nonylphenyl)phosphite, dilauryl hydrogenphosphite, diphenylmonodecyl phosphite, trilauryltrithiophosphite and diphenyl hydrogenphosphite.

According to the invention invention, a phosphoric ester can be used as the extreme-pressure additive. For the phosphoric esters, examples include triphenyl phosphate, triethyl phosphate, tributyl phosphate, tris(2-ethylhexyl)phosphate, tridecyl phosphate, diphenylmono(2-ethylhexyl)phosphate, tricresyl phosphate, trioctyl phosphate and tristearyl phosphate.

An acid phosphoric ester can be also desirably used as the extreme-pressure additive in the present invention. The acid phosphoric esters desirably are methyl acid phosphate, isopropyl acid phosphate, butyl acid phosphate, 2-ethylhexyl acid phosphate, isodecyl acid phosphate, tridecyl acid phosphate, and lauryl acid phosphate.

An added amount of any of those organometal compounds, organofatty acid compounds or derivatives, or organophosphorus compounds is 0.5 to 10% by weight to the total amount of a rust protective oil that forms a rust preventive film. If it is below 0.5% by weight, the rust protective coating film having a self-absorbing function cannot be formed and therefore, the desired characteristics cannot be achieved. On the other hand, if 0.5% by weight or more is added, it has been confirmed that its vibration resistant characteristics are even worse. Preferably an amount of 1 to 4 percent of extreme-pressure additive is used.

In this invention, in particular, one or more types of molybdenum dithiophosphates and/or molybdenum dithiocarbamates can be suitably used, wherein molybdenum dithiophosphates are generally expressed by a chemical formula (i),

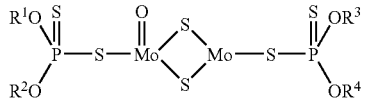

(i)

where $R^1$, $R^2$, $R^3$ and $R^4$ are alkyl groups with 1~24 carbon atoms or aryl groups with 6~30 carbon atoms, and wherein molybdenum dithiocarbamates are generally expressed by a chemical formula (ii),

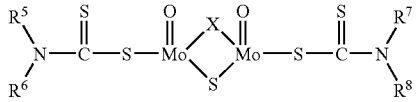

(ii)

where $R^5$, $R^6$, $R^7$ and $R^8$ are alkyl groups of 1~24 carbon atoms and X is O or S. An added amount of one or more types of organomolybdenum compounds selected from a group of molybdenum dithiophosphates and molybdenum dithiocarbamates is preferably 0.5 to 10% by weight, and more preferably 1 to 4% by weight to the total amount of a rust preventive oil which forms a coating layer.

Desirably the rust preventive film containing an extreme-pressure additive is formed all over the bearing components during the assembling process, the bearing components for example the race, inner and outer wheel and rolling components such as balls are fully protected even for sudden vibrations from transportation. The protection occurs as a result of the formation of the film containing the extreme-pressure additive before transportation.

According to the invention, the outer and inner pieces and rolling elements of the bearings are preferably a high performance chromium bearing steel and a highly anticorrosive martensite stainless steel. For the high performance chromium bearing steel, there is a high-quality vacuum-degassed high performance chromium bearing steel (JISG4805SUJ2, AISI/SAE52100) for example. For the martensite stainless steel, there is DD400, SUS440C (JISG430344C, AISI440C). As for a material of the rolling elements, boron nitride based ceramic material can desirably be used as well.

For the rust preventive oil used in the present invention, well-known rust preventive oils can be used. For example, it can be a mineral oil or synthetic oil such as diesters, polyolesters and poly(α-olefin) (PAO).

The rust preventive agent used according to the invention included in the rust preventive oil, include sorbitan ester rust preventive agents, carboxylic acid rust preventive agents, carboxylic salt rust preventive agents, sulfonic salt rust preventive agents, amine rust preventive agents, phosphorus rust preventive agents and phosphoric salt rust preventive agents. The sorbitan ester rust preventive agents that can be desirably used according to the present invention are sorbitan monolaurate, sorbitan trilaurate, sorbitan monostearate, sorbitan tristearate, sorbitan monooleate and sorbitan trioleate. One of these or a mixture of two or more can be used.

The carboxylic acid rust preventive agents which are desirably used in the present invention include undecylic acid, myristic acid, stearic acid, dodecylphenylstearic acid, p-n-dodecyloxybenzoic acid, α-hydroxypalmitic acid, and the like. The carboxylic salt rust preventive agents advantageously used in the present invention Zn-laurate, Zn-naphtate, Ba-phenylstearate, Ca-naphtate, and the like.

The sulfonic salt rust preventive agents desirably used in the present invention are Zn-sulfonate, Ba-petroleum sulfonate, Ca-petroleum sulfonate and the like. The amine rust preventive agents include octadencenyl amine, cyclohexylamine and so on. The phosphorus rust preventive agents are tri-P-cresyl phosphate, cetylmethyl acid phosphate and the like.

Preferably sorbitan ester rust preventive agents are used as rust preventive agents in the present invention. Moreover, rust preventive compounds of the present invention for bearings of memory devices can include a stabilizer, antioxidant or surfactant of every sort that is usually used by those skilled in the art within the intended range of the invention.

In another aspect of the invention, a method of manufacturing bearings having self contained vibration resistant properties is provided. After assembling and cleaning the bearing, but before adding a lubricating oil or a grease composition to fill bearing spaces, the bearing is immersed in a rust preventive solution bath with a volatile solvent and a rust preventive oil that contains an extreme-pressure additive in and amount 0.5 to 10% preferably 1 to 4% by weight of rust preventive oil. Preferably the rust preventive oil includes a rust preventive agent. The bearing is then dried and the volatile solvent is removed. As a result of this process, a rust and vibration resistant film containing the extreme-pressure additive coats all of the surfaces of the bearing. Therefore, deterioration of the bearing due to vibrations from a badly conditioned road at the time of transportation is retarded.

Desirably the rust and vibration resistant film coats all of the surfaces of the bearing including the race, inner and outer wheel and rolling components such as balls. When the bearings according to the invention are incorporated in motors, the motors can endure vibrations from a badly conditioned road at the time of transportation, and unexpectedly exhibit better results than with motors in which bearing spaces are filled with a grease composition or a lubricating oil containing an extreme-pressure additive.

According to the invention, the bearings are assembled, the assembled bearings are cleaned and then immersed in a bath of a rust preventive treatment solution containing a volatile solvent and a rust preventive oil which includes a rust preventive agent and an extreme-pressure additive. Then the bearings dried to remove the volatile solvent. Thus, a rust and vibration resistant film including the extreme-pressure additive is provided all over the bearing surfaces, and the vibration resistant bearing is formed. The ratio of a rust preventive oil to a volatile solvent is 1:99 to 10:90 (percentage by volume). For the volatile solvent, desirably a fluorine based solvent or an alcohol based solvent are used.

In another aspect of the invention, a grease or a lubricating oil optionally is injected in the bearing spaces of a vibration resistant bearing obtained in the present invention. Desirably, the grease or lubricating oil contains an extreme-pressure additive of 0.5 to 5% by weight is dispensed into bearing spaces of a vibration resistant bearing which results in excellent endurance characteristics against vibrations caused by transportation on a badly conditioned road.

The vibration resistant bearing can be used in motors for air conditioners or information devices. More particularly, it can be built in a HDD (hard disk drive) or FDD (floppy disk drive) of computers, a CDD (compact disk drive), a MOD (optical disk drive), a VCR (videotape recorder), power units and the like. Therefore, large transportation system advantages can be obtained in that motors including the bearings do not have to be specially packaged for transportation to an assembling factory. The requirement for extra wrapping which or for preparing and rotating packages in specific orientations has been eliminated with a significant cost saving. Moreover, there is another advantage in that an aging time for motors for lubricating oil to spread well can be shortened.

In a further aspect of the invention, a film forming solution for coating bearings for vibration resistance is provided. The film forming solution contains a volatile solvent, a rust preventive oil, a rust preventive agent, and an extreme-pressure additive in an amount of 0.5% to 10% by weight preferably 1% to 4% of said rust preventive oil. The solvent is desirably a fluorine based solvent or optionally an alcohol based solvent. Desirably the extreme-pressure additive is one or more organometallic compounds, organofatty acid compounds, organofatty acid derivatives or organophosphoric acid compounds, preferably molybdenum diphosphate (Mo-DTP), molybdenum dithiocarbamate (Mo-DTC) or tricresyl phosphate (TCP). The film forming solution preferably has a ratio of the rust preventive oil to the volatile solvent of 1:99 to 10:90 percentage by volume.

EXAMPLES

The present invention is further described below in detail based on the following examples.

General use bearings (608) were obtained. After assembly of the bearings, the bearings were cleaned, and then immersed in baths containing a rust preventive treatment solution composed of a volatile solvent and a rust preventive oil which contained a rust preventive agent and an extreme-pressure additive as listed in Table 1. The bearings were dried and the volatile solvent was removed. The resulting bearings with vibration resistant film including the extreme-pressure additive agent coating all of the bearing surfaces were tested.

TABLE 1

| | rust preventive oil | rust preventive agent | extreme-pressure additive (addition) | Volatile solvent (fluorine solvent) rust preventive oil: volatile solvent | extreme-pressure additive for a grease or lubricating oil |
|---|---|---|---|---|---|
| Example 1 | POE | A (3%) | MoDTP (1%) | 5:95 (vol. ratio) | G<br>TCP (1%) |
| Example 2 | POE | B (2%) | TCP (2%) | 5:95 (vol. ratio) | O<br>MoDTP (1%) |
| Example 3 | DE | C (3%) | MoDTC (3%) | 5:95 (vol. ratio) | G<br>None |

TABLE 1-continued

| | rust preventive oil | rust preventive agent | extreme-pressure additive (addition) | Volatile solvent (fluorine solvent) rust preventive oil: volatile solvent | extreme-pressure additive for a grease or lubricating oil |
|---|---|---|---|---|---|
| Example 4 | CD | A + B + C (5%) | TCP (2%) MoDTC (1%) | 5:95 (vol. ratio) | G MoDTP (1%) TCP (2%) |
| Example 5 | CD | A + B + C (10%) | TCP (1%) MoDTP (1%) | 5:95 (vol. ratio) | G None |
| Example 6 | POE | A + B + C (5%) | TCP (2%) | 5:95 (vol. ratio) | O TCP (2%) |
| Comparative Example 1 | POE | A (3%) | None | 5:95 (vol. ratio) | G TCP (1%) |
| Comparative Example 2 | POE | A (3%) | None | 5:95 (vol. ratio) | G None |

POE: polyolester
DE: diester
CE: carbonic ester (including branched alkyls with 13 ~ 15 carbon atoms)
A: sorbitan monolaurate
B: sorbitan tristearate
C: sorbitan monooleate
G: grease
O: lubricating oil
MoDTP: molybdenum dithiophosphate
MoDTC: molybdenum dithiocarbamate
TCP: tricresyl phosphate The grease employed was a well-known grease which is disclosed in Japanese unexamined patent application publication No. 2001-139979, which contains a carbonic ester as a base oil and lithium stearate as a thickening agent. The lubricant oil employed is a well-known poly(α-olefin)-related oil.

The bearings of Table 1 were built in motors for air conditioners. A vibration test was conducted under the conditions shown in Table 2.

TABLE 2

| Conditions | Lower limit Frequency | Lower limit Level | Upper limit Frequency | Upper limit Level | Sweep condition | Vibration duration | Mounting method |
|---|---|---|---|---|---|---|---|
| | 10 Hz | 0.5 G | 20 Hz | 0.5 G | 5 min./log | 7 hours | Package box |

The results are shown in Table 3.

TABLE 3

| | Anderon L | Anderon M | Anderon H | Disassembled analysis | Overall evaluation |
|---|---|---|---|---|---|
| Example 1 | O | | O | O | O |
| Example 2 | O | | O | O | O |
| Example 3 | O | | O | | O |
| Example 4 | O | O | O | O | O |
| Example 5 | O | O | O | O | O |
| Example 6 | O | O | O | O | O |
| Comparative Example 1 | | X | | | |
| Comparative Example 2 | X | x | x | x | x |

The bearing characterization test was conducted for their acoustic characteristics at room temperature. Anderon values of Low band (L), Medium band (M) and High band (H) were measured at an outer diameter surface of the fixed outer ring of a ball bearing by contacting an acceleration sensor, for the outer ring radial direction vibration, while rotating an inner ring of the ball bearing at 1800 rpm. Each of the Anderon bands was measured as vibration frequency bands for an acoustic noise defined as;

Low band (L): 50 Hz to less than 300 Hz

Medium band (M): 300 Hz to less than 1,800 Hz

High band (H): 1,800 Hz to less than 10,000 Hz.

Noise in the Anderon M band is generally considered annoying to a person's ears.

The results were evaluated by the following three-grade system.

| | |
|---|---|
| O: | There is almost no change observed from before and after the test. (0.1 or less) |
| : | There is a small change observed from before and after the test. (0.1 ~ less than 0.2) |
| X: | There is a large change observed from before and after the test. (0.2 or higher) |

As is obvious from the results in Table 3, bearings treated according to the invention can endure the strong vibration compared to the untreated comparative examples. Thus, bearings having the vibration resistant film of the present invention do not deteriorate in their performances as components even if they are transported on a badly conditioned road. Therefore, components for electric appliances for household use many information devices, or motors can be transported to an assembling factory without special packaging, thereby providing beneficial industrial advantages through reductions in packaging material consumption.

The foregoing is considered as illustrative only to the principles of the invention. Further, since numerous changes and modification will occur to those skilled in the art, it is not desired to limit the invention to the exact construction, examples and operation shown and described above, and accordingly all suitable modifications and equivalents may be resorted to, falling within the scope of the invention.

The invention claimed is:

1. A self contained vibration resistant bearing comprising:

a bearing coated with a film dried on the surfaces of said bearing;

said film formed from a film forming solution containing a volatile solvent and a rust preventive oil having an extreme-pressure additive content of 0.5 to 10% by weight, the ratio of the rust preventive oil to the volatile solvent being 1:99 to 10:90 percent by volume.

2. A self contained vibration resistant bearing according to claim 1 wherein said film covers all the surfaces of said bearing.

3. A self contained vibration resistant bearing according to claim 2 further comprising:

said bearing having an inner wheel, an outer wheel and rolling components;

said inner wheel, said outer wheel and said rolling components coated with said film.

4. A self contained vibration resistant bearing according to claim 2 wherein the extreme-pressure additive is one or more compounds selected from a group consisting essentially of organometallic compounds, organofatty acid compounds, organofatty acid derivatives or organophosphoric acid compounds.

5. A self contained vibration resistant bearing according to claim 2 wherein said extreme-pressure additive is a molybdenum dithiophosphates or a molybdenum dithiocarbamates said molybdenum dithiophosphates are generally expressed by a chemical formula (i)

(i)

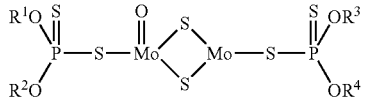

where $R^1$, $R^2$, $R^3$ and $R^4$ are alkyl groups with 1~24 carbon atoms or aryl groups with 6~30 carbon atoms;

said molybdenum dithiocarbamates are generally expressed by a chemical formula (ii)

(ii)

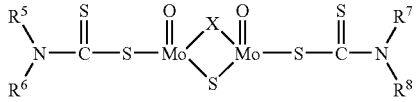

where $R^5$, $R^6$, $R^7$ and $R^8$ are alkyl groups of 1~24 carbon atoms and X is O or S.

6. A self contained vibration resistant bearing according to claim 5 wherein said extreme-pressure additive includes two more compounds selected from molybdenum dithiophosphates and molybdenum dithiocarbamates.

7. A self contained vibration resistant bearing according to claim 6 wherein said extreme-pressure additive is a molybdenum dithiophosphate and a molybdenum dithiocarbamate.

8. A self contained vibration resistant bearing according to any one of claims 1–7 the rust preventive oil is a mineral oil or synthetic oil.

9. A self contained vibration resistant bearing according to claim 8 wherein said rust preventive oil is a carbonic ester, diester, polyolester, poly(α-olefin) (PAO).

10. A self contained vibration resistant bearing according to claim 2 wherein the extreme pressure additive is one ore more of molybdenum diphosphate (Mo-DTP), molybdenum dithiocarbamate (Mo-DTC) tricresyl phosphate (TCP).

11. A self contained vibration resistant bearing according to claim 2 wherein the rust preventive oil contains one or more types of rust preventive agents selected from a group comprising sorbitan ester rust preventive agents, carboxylic acid rust preventive agents, carboxylic salt rust preventive agents, sulfonic salt rust preventive agents, amine rust preventive agents, phosphorus rust preventive agents and phosphoric salt rust preventive agents.

12. A self contained vibration resistant bearing according to any one of claims 1 to 7, wherein said bearing contains spaces, and a grease or lubricating oil is dispensed into said spaces after said film has been dried on the surface of said bearing.

13. A self contained vibration resistant bearing according to claim 12, wherein the grease or lubricating oil contains an extreme-pressure additive of 0.5 to 5% by weight.

14. A method of manufacturing a self contained vibration resistant bearing comprising:

a) assembling said bearing;

b) cleaning said bearing;

c) immersing said bearing in a bath of a film forming solution;

d) said film forming solution containing:

i)a volatile solvent;

ii) a rust preventive oil; the ratio of the rust preventive oil to the volatile solvent being 1:99 to 10:90 percent by volume;

iii) a rust preventive agent and;

iv) an extreme-pressure additive in an amount of 0.5 to 10% by weight of said rust preventive oil;

e) drying said bearing to remove said volatile solvent to form a rust preventive and vibration protective film covering all of said bearing.

15. A method of manufacturing a self contained vibration resistant bearing according to claim 14 wherein said bearing including an inner wheel, an outer wheel, and rolling components having a plurality of surfaces; said rust preventive and vibration protective film forming on all of said surfaces.

16. A method of manufacturing a self contained vibration resistant bearing according to claim 15 wherein the extreme-pressure additive is one or more compounds selected from a group consisting essentially of organometallic compounds, organofatty acid compounds, organofatty acid derivatives or organophosphoric acid compounds.

17. A method of manufacturing a self contained vibration resistant bearing according to claim 16 wherein the extreme-pressure additive is a molybdenum dithiophosphates or a molybdenum dithiocarbamates, said molybdenum dithiophosphates generally expressed by a chemical formula (i)

(i)

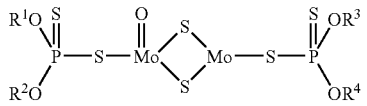

where $R^1$, $R^2$, $R^3$ and $R^4$ are alkyl groups with 1~24 carbon atoms or aryl groups with 6~30 carbon atoms, and said molybdenum dithiocarbamates generally expressed by a chemical formula (ii)

(ii)

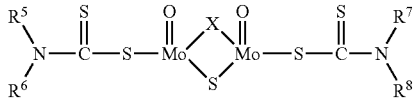

where $R^5$, $R^6$, $R^7$ and $R^8$ are alkyl groups of 1~24 carbon atoms and X is O or S.

18. A method of manufacturing a self contained vibration resistant bearing according to claim 17 wherein said extreme-pressure additive includes two more compounds selected from molybdenum dithiophosphates and molybdenum dithiocarbamates.

19. A method of manufacturing a self contained vibration resistant bearing according to claim 18 wherein said extreme-pressure additive is a molybdenum dithiophosphate and a molybdenum dithiocarbamate.

20. A method of manufacturing a self contained vibration resistant bearing according to claim 15 wherein the extreme-pressure additive is one or more compounds selected from molybdenum diphosphate (Mo-DTP), molybdenum dithiocarbamate (Mo-DTC) or tricresyl phosphate (TCP).

21. A method of manufacturing a self contained vibration resistant bearing according to claim 15 wherein the rust preventive oil is a mineral oil or synthetic oil.

22. A method of manufacturing a self contained vibration resistant bearing according to claim 21 wherein said rust preventive oil is a carbonic ester, diester, polyolester, poly (α-olefin) (PAO).

23. A method of manufacturing a self contained vibration resistant bearing according to claim 15 wherein the rust preventive oil contains one or more types of rust preventive agents selected from a group comprising sorbitan ester rust preventive agents, carboxylic acid rust preventive agents, carboxylic salt rust preventive agents, sulfonic salt rust preventive agents, amine rust preventive agents, phosphorus rust preventive agents and phosphoric salt rust preventive agents.

24. A method of manufacturing a self contained vibration resistant bearing according to claim 14 wherein said bearing contains spaces, and a grease or lubricating oil is dispensed into said spaces.

25. A film forming solution for coating bearings to provide vibration resistance comprising said film forming solution containing:

a) a volatile solvent;

b) a rust preventive oil;

c) a rust preventive agent; and d) an extreme-pressure additive in an amount of 0.5 to 10% by weight of said rust preventive oil;

the ratio of the rust preventive oil to the volatile solvent being 1:99 to 10:90 percentage by volume.

26. A film forming solution for coating bearings to provide vibration resistance according to claim 25 wherein said solvent is a fluorine based solvent.

27. A film forming solution for coating bearings to provide vibration resistance according to claim 26 wherein said the extreme-pressure additive is one or more compounds selected from a group consisting essentially of organometallic compounds, organofatty acid compounds, organofatty acid derivatives or organophosphoric acid compounds.

28. A film forming solution for coating bearings to provide vibration resistance according to claim 27 wherein said the extreme-pressure additive is one or more compounds selected from molybdenum diphosphate (Mo-DTP), molybdenum dithiocarbamate (Mo-DTC) or tricresyl phosphate (TCP).

29. A film forming solution for coating bearings to provide vibration resistance according to claim 28 wherein the extreme pressure additive is in an amount of 1 to 4 percent by weight of said rust preventive oil.

30. A self contained vibration resistant bearing according to any one of claim 1 to 7 and 10 to 11 wherein the extreme pressure additive is in an amount of 1 to 4 percent by weight of said rust preventive oil.

31. A method of manufacturing a self contained vibration resistant bearing according to any one of claim 14 to 23 wherein the extreme pressure additive is in an amount of 1 to 4 percent by weight of said rust preventive oil.

32. A motor for information equipment containing bearings according to claim 2.

33. An information device selected from the group of HDD (hard disk drive), FDD (floppy disk drive), a CDD (compact disk drive), a MOD (optical disk drive), a VCR (videotape recorder) containing one or more bearing according to claim 2.

34. An air conditioner containing one or more bearing according to claim 2.

* * * * *